United States Patent [19]

Herubel et al.

[11] Patent Number: 4,781,605

[45] Date of Patent: Nov. 1, 1988

[54] SHAPE MEMORY ELEMENT FOR CONNECTING BRAID ONTO A CONNECTOR

[75] Inventors: Guy Herubel, Marly Le Roi; Jean-Jacques Négre, Nanterre, both of France

[73] Assignee: Souriau & Cie, Boulogne Billancourt, France

[21] Appl. No.: 5,883

[22] Filed: Jan. 21, 1987

[30] Foreign Application Priority Data

Jan. 30, 1986 [FR] France ..... 86 01297

[51] Int. Cl.[4] ..... H01R 13/20

[52] U.S. Cl. ..... 439/161

[58] Field of Search ..... 339/30, DIG. 1, 252 S, 339/252 T, 257 OR, 257 RT, 257, 258 R, 258 T, 258 RR, 262 RR, 276 A, 277 R; 439/161, 919, 932, 816-862, 877-883

[56] References Cited

U.S. PATENT DOCUMENTS

| | | | |
|---|---|---|---|
| 2,988,723 | 6/1961 | Archer | 339/30 |
| 3,835,241 | 9/1974 | Masterson et al. | 174/87 |
| 3,861,030 | 1/1975 | Otte et al. | 339/30 |
| 3,906,623 | 9/1975 | Clabburn et al. | 29/628 |
| 3,985,950 | 10/1976 | Maltz | 174/87 |
| 4,435,229 | 3/1984 | Johnson | 148/11.5 N |
| 4,445,747 | 5/1984 | Neidich | 339/258 RR |
| 4,462,651 | 7/1984 | McGaffigan | 339/DIG. 1 |
| 4,487,465 | 12/1984 | Cherian | 339/30 |
| 4,570,055 | 2/1985 | McMills | 219/541 |
| 4,634,201 | 1/1987 | Kemka | 339/DIG. 1 |

FOREIGN PATENT DOCUMENTS

| | | | |
|---|---|---|---|
| 0053745 | 6/1982 | European Pat. Off. | 339/30 |
| 0081372 | 6/1983 | European Pat. Off. . | |
| 0123376 | 6/1984 | European Pat. Off. . | |
| 0112618 | 7/1984 | European Pat. Off. . | |
| 0161952 | 3/1985 | European Pat. Off. | 9/1 |
| 2166052 | 10/1972 | Fed. Rep. of Germany . | |
| 1482335 | 6/1966 | France . | |
| 2199620 | 9/1972 | France . | |
| 2378382 | 1/1978 | France . | |
| 1579734 | 11/1980 | United Kingdom . | |
| 1327441 | 8/1983 | United Kingdom . | |
| 2128039A | 4/1984 | United Kingdom . | |

OTHER PUBLICATIONS

French Search Report FR 85 04 040, FR 85 04 041, FR 85 04 042, FR 85 11 088.

"Shape Memory Effect, Superelasticity and Damping in Cu-Zn-Al Alloys" Report 78R1, Katholieke Universiteit Leuven, Belgium, by L. Delaey et al., Feb. 1, 1978.

IEEE Transactions on Components, Hybrids and Manufacturing Technology, vol. CHMT-3, Jun. 1980, pp. 226-232, IEEE, New York, U.S.

C. J. Evans, "Connector Finishes, Tin in Place of Gold," p. 226.

Ecker et al., "Expandable Pin for Circuit Board" Sep. 1970.

IBM Disclosure Bulletin, vol. 13, No. 4, pp. 1016-339/30.

*Primary Examiner*—Gil Weidenfeld
*Assistant Examiner*—Paula A. Austin
*Attorney, Agent, or Firm*—Nixon & Vanderhye

[57] ABSTRACT

The invention relates to a shape memory element for connecting braid (1) onto a connector (2).

The element is constituted by a roll (3), with two reversible memorized shape states. A first memorized shape state permits the ensuring of electric contact and the mechanical holding of the braid on the corresponding rear zone of the connector (2), and the second memorized shape state permits the engagement or disengagement of the braid and the rear zone of the connector.

Application for connectors for electric cables.

16 Claims, 3 Drawing Sheets

FIG. 1a I

FIG. 1a II

Figure 1B:
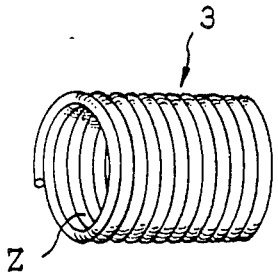
Figure 1B:
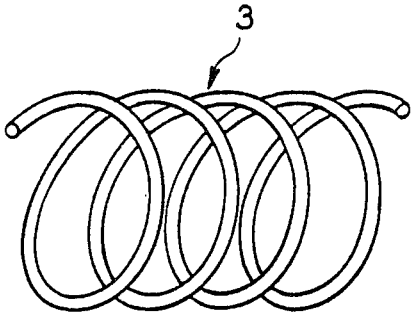
Figure 1B:
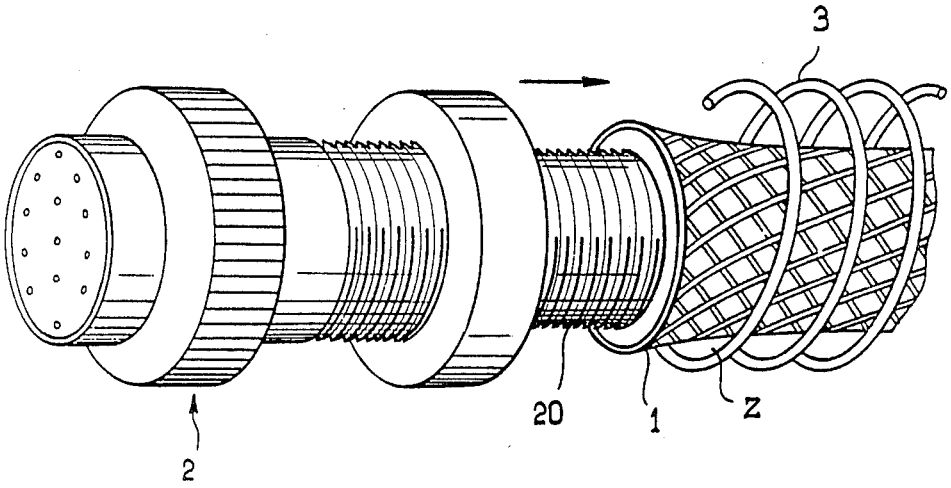

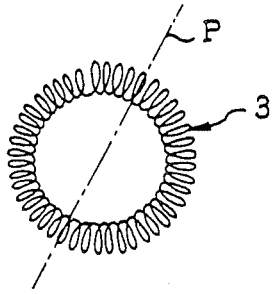
FIG.2 II
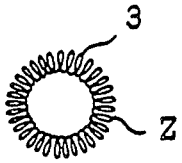
FIG.2 I
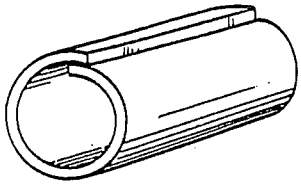
FIG.3a I
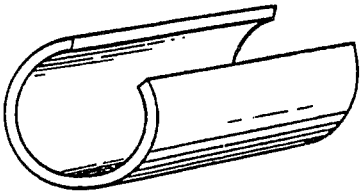
FIG.3a II
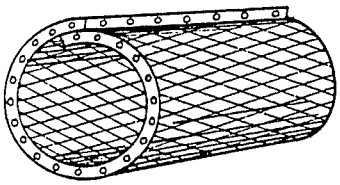
FIG.3b I
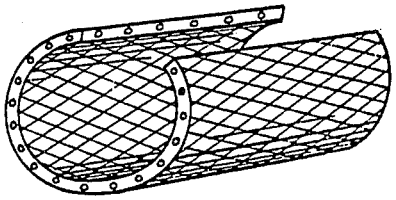
FIG.3b II
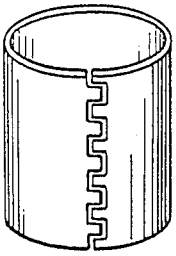
FIG.3c I
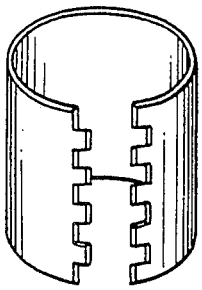
FIG.3c II

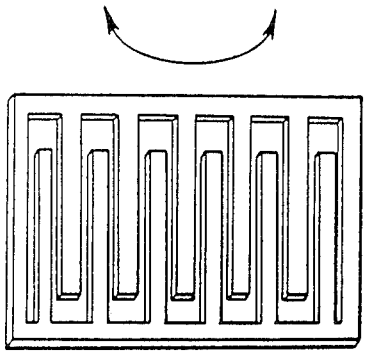
FIG.3d I
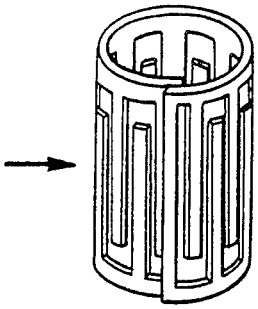
FIG.3d II
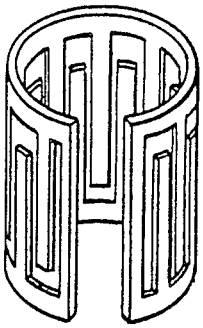
FIG.3d III
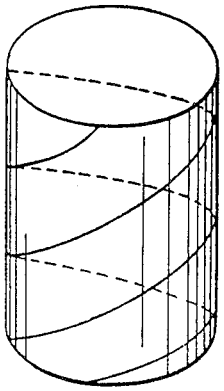
FIG.3e I
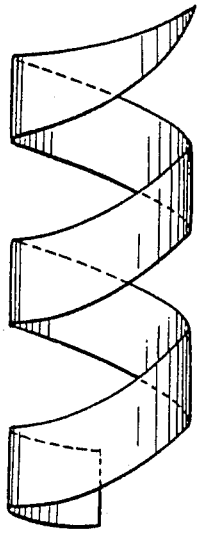
FIG.3e II

SHAPE MEMORY ELEMENT FOR CONNECTING BRAID ONTO A CONNECTOR

FIELD OF THE INVENTION

The present invention relates to a shape-memory element for connecting braid or conductor screening of a cable onto a conductor.

BACKGROUND OF THE INVENTION

Presently, the connection of metallic braid, constituting the screening conductor of an electric cable, is in the general manner effected by means of a copper or copper alloy ring treated by magnetostriction. The metallic braid having been, preliminarily, conveniently positioned on the zone or rear part of the connector intended for this, the mentioned ring, surrounding the braid, is brought to the region of this zone. The treatment by magnetostriction has the effect of causing sufficient shrinking or contraction of the ring onto the braid and thus assures the electric contact and the mechanical holding of the braid on the rear zone of the connector.

This operational arrangement is costly insofar as it necessitates a complicated and difficult to maintain apparatus for the treatment by magnetostriction.

Further, in the case of any necessary disconnection of the cable from the connector, this implies destruction of the ring, which can no longer be carried out.

It has recently been proposed to replace these copper rings with shape memory alloy rings able, under the effect of heating, to take a preliminarily memorised shape state then, by return to ambient temperature, to ensure the electric contact and mechanical holding of the braid on the rear zone or part of the connector.

For satisfactory operation, this type of contact presents however the inconvenience of the impossibility of reutilising the rings used, because of the absence of reversability of the passage from the memorised shape state permitting the mounting of braid onto the rear zone of a connector to the final state in which the electric contact and the holding of braid onto the rear zone of a connector are assured. Further, this type of ring permits in any case an overall radial deformation of the order of one 8%, which, in certain cases, can cause inconvenience in the mounting of the braid.

THE INVENTION

The present invention has the object of providing a shape memory element for connecting braid onto a connector without the mentioned inconveniences.

Another object of the present invention is the provision of a shape memory element for connecting braid onto a connector able to be reused after dismounting of the connector.

Another object of the present invention is the provision of a shape memory element for connecting braid onto a connector with great ease of use and a very wide application.

The shape memory element for connecting braid onto a connector according to the invention is remarkable in that it is constituted by a rolled element with two reversible shape memory states, the passage from one to the other of the shape states being obtained by the modification alone of the temperature of the said element or a part of this, below and/or above the transition temperature Ms of the constituent material of the element, a first memorised shape state permitting the assurance of electric contact and mechanical holding of the braid on the corresponding rear zone of the connector and a second memorised shape state permitting the engagement and/or disengagement of the braid and the mentioned rear zone.

The invention finds application notably in the field of connection, in particular for circular cross-section connectors or even any cross-section of connector.

THE DRAWINGS

The invention will be better understood from reading the description below and studying of the accompanying drawings, in which:

FIGS. 1*a*I and 1*a*II shows according to a first particular embodiment, an element for connecting braid onto a connector in its two memorised shape states;

FIG. 1*b* shows, according to the embodiment of FIGS. 1*a*I and 1*a*II, the element for connecting braid onto a connector in the course of the mounting operation;

FIGS. 2I and 2III shows a variant of the embodiment of the element for connecting braid onto a connector able to be used;

FIGS. 3*a*I, 3*a*II, 3*b*I, 3*b*II, 3*c*I, 3*c*II, 3*d*I, 3*d*II, 3*d*III, 3*e*I and 3*e*II show advantageous variants of the element for connecting braid onto a connector, in accordance with the invention.

THE PREFERRED EMBODIMENT

The invention will now be described in connection with FIGS. 1*a*I and 1*a*II. Roman numerals I and II designate different physical shape states in the various figures.

According to these Figures, the shape memory element for connecting braid onto a connector is constituted, in accordance with the invention, by a rolled element designated 3 with two reversible shape memory states. The passage from one shape state to the other, shown in FIG. 1*a*I and 1*a*II, is obtained by the modification alone of the temperature of the element 3 or a part of it, below and/or above the transition temperature Ms of the constituent material of the element 3. The temperature Ms called the transition temperature is in fact the temperature of initiation of transformation of the material to the martensitic type crystallographic state. The material can also be brought, as is preferred, to a temperature below the finishing temperature of the martensitic state Mf.

The first memorised shape state shown in FIG. 1*a*I, permits assuring the electric contact and mechanical holding of the braid on the corresponding rear zone of the connector. The second memorised shape state shown in FIG. 1*a*I, permits the engagement and/or disengagement of the braid and the rear zone of the mentioned connector.

In FIG. 1*a*I and 1*a*II, the rolled element 3 is shown as formed, in a non-limitative manner, to constitute a substantially cylindrical roll. Preferably, the roll can be constituted by spirals of the same diameter.

The passage from the one memorised shape state to the other of the element 3, can be obtained by means of any source of cold available in the industrial environment, such as for example liquid nitrogen.

In FIG. 1*b*, the element 3 has been shown, in the course of its mounting phase, on the connector 2, the element 3 surrounding the braid 1, as shown in this Figure. In order to permit the introduction of the element 3 around the braid 1 to be connected, it, by means of the mentioned source of cold, is brought into its second memorised shape state, designated II, the state in which the element is in its so-called expanded position, the position which of course permits the introduction of the rear part or zone designated 20 of the connector into the open end of the braid 1, and the suitable positioning of the element 3 at the region of this rear zone 20. The return to ambient temperature of the element 3 brings this into the shape memory position designated I, the so-called retracted position, in which the electric contact and mechanical holding of the braid 1 onto the rear part 20 of the connector are assured.

It should of course be noted, on the passage from one memorised shape state to the other of the element 3, this undergoes substantially no elongation, the only transformations undergone by the element 3 corresponding to a variation of diameter of the spirals and their number in one and the other memorised shape state.

The transformations undergone by the element 3 are such that, in the first memorised shape state, which permits assurance of the electric contact and the mechanical holding of the braid 1 on the corresponding rear zone 20 of the connector, the constituent material of the element 3 is in the austenitic type crystallographic state, whilst in the second memorised shape state, which permits the engagement and/or disengagement of the braid 1 and the mentioned rear zone 20, it is on the other hand in the martensitic type crystallographic state.

Preferably, but in a non-limitative manner, the rear zone or part of the connector 20, can be provided with projecting parts intended to assure the good electric contact and the good mechanical holding of the braid 1 on it. In FIG. 1*b* is shown by way of example, the projecting parts of the rear zone or part 20 of the connector 2, in the form of a sharp edge threading, into which the metallic wires constituting the braid 1 can be engaged by wedging, under the effect of pressure exerted by the element when this is returned into its memorised shape state I.

It will of course be understood that the previously mentioned transformations undergone by the element 3, are for the main part an essentially radial modification of the spiral of the roll. This effect, particularly advantageous in the application or connection of a metallic braid 1 to the rear part 20 of a connector, can be obtained by providing a so-called education process, permitting the obtaining of the mentioned effect.

By way of non-limitative example, the element 3 can be constituted in a shape memory material, from in the group nickel-titanium, nickel-titanium-iron, copper-zinc-aluminium, and copper-aluminium-nickel, nickel-aluminium, in the form of intermetallic compounds or in alloyed form.

The roll 3 can preferably be constituted from a wire or the like, of which the constituent material comes from the mentioned group. By way of example, trials have been carried out with a wire of 3 mm diameter, constituted of an alloy having approximately 4% by atomic mass of aluminium, 25% of zinc and the balance percentage of copper and for which the transition temperature Ms is in the region of 75° C. The method of production presently described permits satisfying of the accounting requirements relating to the conditions of use of connectors in the industrial environment. The education process of the element 3 will now be described.

Preliminarily to the so-called education process, the roll must first be made into the desired shape at ambient temperature, that is to say the shape substantially corresponding to the first memorised shape state designated I, of FIG. 1*a*.

A rod of shape memory material or a wire, of which the composition is that previously indicated, is first brought to a temperature permitting the bringing of all the rod or wire to the crystallographic state having the two $\alpha$ and $\beta$ phases in equilibrium. By way of example, the mentioned rod can be brought to a temperature of 500° C. This raising of temperature has the effect of rendering the raw material more malleable. The rod is then returned to ambient temperature, with or without quenching, in a manner to permit the so-called shaping.

The so-called shaping, that is to say the shaping to the definitive state constituting the final state, above the transition temperature Ms of the material, is then carried out by plastic deformation of the rod at ambient temperature. The rod is rolled on a support or mandrel, by means of a winding machine or any other means, in order to form the roll 3. Preferably, this is carried out in order to present abutting spirals.

The roll 3 thus constituted is then, in the absence of any mechanical stress, brought to high temperature, in a manner to bring the constituent shape memory material of the roll into the austenitic type crystallographic phase. Typically, the roll 3 can be brought to a temperature between 700° C. and 850° C., then it is submitted to quenching, in order to eliminate quenching gaps, with the roll being maintained above the transition temperature Ms of the material. Then the roll 3 is submitted to the so-called education stage.

The education consists of applying to the roll 3, a mechanical stress able to be imposed on the roll, a deformation constituting, for the roll, a path through which the roll will pass from its final shape state to its different successive shape states, which in effect constitute the mentioned path.

To this end, a mechanical stress is applied to the roll 3, the stress being directed in the direction of deformation of the roll. In the mentioned example, where the deformation consists of a rotation and a radial deformation of the spirals, the force or stress can be applied to the roll 3, which is in the shape state corresponding to the memorised shape state I of FIG.1*a*I, by means of a tool of the helicoidal die type, of which the trajectory corresponds for example to the mentioned path, in a manner,. to bring the element 3 to its memorised shape state II in FIG. 1*a*II; advantageously the die is substantially of the shape designated II corresponding to the second memorised shape state. The element 3 can of course be introduced into the die by tension. The amplitude of the stress applied to the roll 3 is chosen such that this does not exceed substantially the limit of elastic deformation of the roll at the temperature above the transition temperature Ms. Then, the stress being maintained, the roll is cooled and brought to a temperature less than its transition temperature Ms, and preferably below its finishing temperature of the martensitic state Mf. The roll 3, under the effect of the stress, is deformed by plastic deformation, in the direction imposed by the stress. It is deformed by a number of turns by rotation of its spirals which depend upon the stress imposed, from characteristics of the roll of which the initial number of spirals, and the modification of diameter of spirals is transferred by a modification of the number of turns or spirals, without appreciably changing the length of the roll 3.

The roll 3 is then returned to a temperature greater than the temperature Ms, the stress being maintained.

The temperature transitions below and above the transition temperature Ms of the material, the stress being maintained, are repeated cyclically. It can be noted that a repetition of the mentioned transitions greater than five times, in fact permits a quasi-indefinite later use, of the roll 3, by a modification alone of its temperature.

Of course, the mentioned process of education does not prejudge the deformation applied to the roll 3. In effect, the tool permitting the carrying out of the education process, previously designated a die, can be replaced by a cylindrical element mounted for rotation and translation on a threaded axle, and on which, a motor couple is applied. The movement in translation and rotation of the cylinder, an end at least of the roll 3 being fixed to the cylinder, has the effect of causing the corresponding education of the roll 3, along the resulting path of the composition of the mentioned movements of rotation and translation.

Variants

A variant of the shape memory element for connecting braid onto a connector, in accordance with the invention, will now be described in connection with FIGS. 2I and 2II.

According to these Figures, the roll 3 is arranged in a manner to form a torus. The median plane of the spirals of the roll 3 is substantially oriented on a diametral plane P of the torus. Of course, it will be understood that the roll 3 having already been formed, as has been described in connection with FIGS. 1*a*I, 1*a*II and 1*b*, this is then shaped in a manner to produce a torus. In FIG. 2I, the shape state designated I corresponds also to the first memorised shape state permitting the assuring of the electric contact and mechanical holding of the braid on the corresponding rear zone of the connector, and the shape state designated II in FIG. 2II corresponds on the other hand to the second memorised shape state, permitting the engagement and/or disengagement of the rear zone and of the braid, this state corresponding to the expanded state.

Preferably, as is shown in FIGS. 2I and 2II, the element 3 in the first memorised shape state, in which the electric contact and mechanical holding of the braid on the rear zone of the connector are assured, is such that the spirals forming the roll are abutting, at least in the region of the contact zone designated Z between the spirals and the braid. Of course, it will be understood in the case of FIGS. 1*a*I and 1*a*II where the element is formed in a manner to constitute a substantially cylindrical element, the spirals are abutting throughout the totality of their circumference, when the element is in its first memorised shape state.

In the case of the variant of FIGS. 2I and 2II, the process of education can be modified as follows: the roll 3 having been formed and treated in a substantially identical manner, as far as the phase permitting the elimination of quenching gaps, the so-called education is then carried out according to stages analogous to those previously described, only the tool permitting the application of mechanical stress being of course modified.

In order to obtain a process of education which is particularly simple and easy to carry out in an industrial environment, the tool can, in the case of a process of education applied to the element 3 shown in FIGS. 2I and 2II, consist in a non-limitative manner, of a rigid cone, on the point of which the element 3 is engaged, this being in its initial shape state corresponding substantially to the memorised shape state designated I, being brought in contact with the wall of the cone on a directrix line of it. The deformation stress permitting the bringing of the element 3 into its memorised shape state, corresponding to the second shape state designated II, can then be applied by a female conical element having an opening angle identical to that of the rigid cone previously mentioned, permitting the exerting of a uniform force on the element 3, which causes the displacement of this, in translation along the axis of longitudinal symmetry of the rigid cone. This mode of operation is particularly significant, insofar as the element 3 can then be submitted, in a precise manner, to a deformation due to the adjustment alone of the stroke of the female conical element with respect to the rigid cone.

Of course, the application of the mechanical stress and the transitions of temperature below and above the temperature transition Ms of the constituent material of the roll 3, are repeated as previously described.

Another variant of the shape memory element for connecting braid, in accordance with the invention will now be described in connection with FIGS. 3*a*I, 3*a*II, 3*b*I and 3*b*II, 3*c*I, 3*c*II, 3*d*I, 3*d*II, 3*d*III, 3*e*I and 3*e*II.

In accordance with FIGS. 3*a*I and 3*a*II, the roll element can be constituted by a substantially cylindrical sleeve either slit or not.

The sleeve is for example slit along one of its generatrix lines. The first memorised shape state, designated I in FIG. 3*a*I and in which the electric contact and the mechanical holding of the braid are assured, permits a covering of the edges of the slit of the sleeve.

The sleeve can advantageously, as shown in FIGS. 3*a*I, 3*a*II, 3*b*I and 3*b*II, be constituted by a sheet of shape memory material of the composition mentioned cut then rolled or by a cloth or array of shape memory material. The array or cloth can in this case be constituted by an arrangement of interlaced wires of shape memory material. The totality or a part only of the wires can be constituted in the shape memory material mentioned, other wires being able to be constituted by a conventional material, piano wire or the like being able to assure the sleeve a basic infrastructure. When it is constituted by a cloth or array, the sleeve can assure a better screening capacity and the greatest flexibility of use.

According to another variant such as shown in FIGS. 3*c*I and 3*c*II, the edges of the slit can have indentations, these being overlapped in the first shape memory state, designated I, in which the electric contact and mechanical holding of the braid are assured.

Another also very advantageous variant can be produced as shown in FIGS. 3*d*I, 3*d*II and 3*d*III. In these Figures, the body of the sleeve is constituted by flexible overlapping blades. The flexible blades are directed substantially in the direction parallel to the generatrix lines of the sleeve.

The sleeve, as shown in FIG. 3*d*I, can be made from a sheet of shape memory metallic material by stamping and then rolling. This embodiment is particularly well adapted to connecting metallic braids of cables because of the great degree of freedom from swelling, in the central part, of the sleeve due to the flexibility of the blades in the region of their free ends. Preferably, the blades, in their longitudinal direction, can be abutting or nearly abutting.

Another variant of the sleeve will be described in connection with FIGS. 3*e*I and 3*e*II. In these Figures, the sleeve is shown slit along a continuous line oblique with respect to the generatrix lines of the body of the sleeve. In this embodiment, the sleeve can advantageously be constituted by a rolled ribbon, the edges of the ribbon in the first shape memory state, designated I, in which the electric contact and mechanical holding of the braid are assured being substantially abutting.

Of course, for all the embodiments shown in FIGS. 3*a*I to 3*e*II, the corresponding rolled elements are submitted to a process of education analagous to the process of education already described, this consisting, essentially, of a cycle of passages from the state designated I to the state designated II, by application of a mechanical stress exerted by means of an appropriately adapted tool, the entire sleeve, or a deformation zone at least of this, being brought in correspondence to a temperature below and/or above the previously defined transition temperature.

There has thus been described a particularly advantageous shape memory element for connecting braid on a connector in which the percentage of overall radial deformation can without inconvenience reach 20%, which permits enhancing of the ease and convenience of production of these elements according to the invention, and then their use.

We claim:

1. A shape memory element for connecting braid to a connector, comprising a rolled element formed of a homogeneous material at least a portion of which having two reversible physical shape memory states, passage from each one of said two reversible physical shape memory states to the other being obtained only by modification of temperature and independent of any associated structure of at least a portion of said element, below and/or above a transition temperature Ms of constituent material of said element, a first memorized shape state permitting assuring of electric contact and mechanical holding of said braid on a corresponding rear zone of said connector and a second memorized shape state permitting engagement and/or disengagement of said braid and said rear zone.

2. An element according to claim 1, wherein said element is constituted of shape memory material from the group: nickel-titanium, nickel-aluminium, nickel-titanium-aluminium, copper-zinc-aluminium and copper-aluminium-nickel in alloyed form or intermetallic composition form.

3. An element according to claim 1, wherein said first memorised shape state permitting assuring electric contact and mechanical holding of said braid on said corresponding rear zone of the connector, corresponds to an austentitic type crystallographic state of said constituent material of said element, said second memorised shape state permitting engagement and/or disengagement of said braid and said rear zone corresponding to a martensitic type crystallographic state.

4. An element according to claim 1, wherein said rolled element is constituted by a roll.

5. An element according to claim 4, wherein said roll is formed in a manner to constitute a substantially cylindrical element.

6. An element according to claim 4, wherein said roll is constituted by spirals each having the same diameter.

7. An element according to claim 6, wherein said element is a torus, a median plane of said spirals of said roll being substantially oriented on a diametral plane of said torus.

8. An element according to claim 6, wherein said first memorised shape state, in which electric contact and mechanical holding of said braid on said rear zone of said connector are assured, said spirals forming said roll are abutting, at least in a region of a contact zone between said spirals and said braid.

9. An element according to claim 6, wherein said element is formed in a manner to constitute a substantially cylindrical element, said spirals are abutting substantially throughout the totality of their circumference.

10. An element according to claim 1, wherein said rolled element is a slit substantially cylindrical sleeve.

11. An element according to claim 10, wherein said sleeve is slit on one of its generatrix lines, said first memorised shape state in which the electric contact and mechanical holding of said braid are assured permitting covering of edges of said slit of said sleeve.

12. An element according to claim 10, wherein said sleeve is formed of a sheet or by a cloth or array of shape memory material.

13. An element according to claim 10, wherein said edges of said slit have indentations, said indentations overlapping in said first shape memory state in which electric contact and mechanical holding of said braid are assured.

14. An element according to claim 10, wherein said body of said sleeve is constituted by flexible overlapped blades, said flexible blades being directed substantially in a direction parallel to the generatrix lines of said sleeve.

15. A shape memory element for connecting braid to a connector, comprising a rolled element having two reversible shape memory states, passage from one shape state to the other being obtained by modification alone of temperature of said element or a part of it, below and/or above a transition temperature Ms of constituent material of said element, a first memorised shape state permitting assuring of electric contact and mechanical holding of said braid on a corresponding rear zone of said connector and a second memorised shape state permitting engagement and/or disengagement of said braid and said rear zone, wherein said rolled element is a slit, substantially cylindrical sleeve, wherein said sleeve is slit along a continuous line oblique with respect to the generatrix lines of said sleeve.

16. An element according to claim 15, wherein said element is by a rolled ribbon, edges of said ribbon in said first shape memory state in which electric contact and mechanical holding of said braid are assured being substantially abutting.

* * * * *